US006274012B1

(12) United States Patent
Santoyo

(10) Patent No.: US 6,274,012 B1
(45) Date of Patent: Aug. 14, 2001

(54) ELECTRODE EDGE STRIP WITH INTERIOR FLOATING RETAINING PINS

(75) Inventor: Manuel G. Santoyo, Tucson, AZ (US)

(73) Assignee: Quadna, Inc., Tucson, AZ (US)

( * ) Notice: Subject to any disclaimer, the term of this patent is extended or adjusted under 35 U.S.C. 154(b) by 0 days.

(21) Appl. No.: 09/435,230

(22) Filed: Nov. 5, 1999

(51) Int. Cl.[7] ..... C25B 9/00
(52) U.S. Cl. ..... 204/279; 204/281
(58) Field of Search ..... 204/279, 280, 204/281

(56) References Cited

U.S. PATENT DOCUMENTS

| | | | |
|---|---|---|---|
| 4,406,769 | 9/1983 | Berger | 204/281 |
| 4,776,928 | 10/1988 | Perlich | 204/12 |
| 5,314,600 | 5/1994 | Webb et al. | 204/279 |
| 5,549,801 | 8/1996 | Perlich et al. | 204/279 |
| 6,193,862 * | 2/2001 | Cutmore et al. | 204/281 |

* cited by examiner

*Primary Examiner*—Bruce F. Bell
(74) *Attorney, Agent, or Firm*—Antonio R. Durando

(57) ABSTRACT

An electrode edge protector includes two distinct components that cooperate to provide a tight and durable fit over the edge of an electrode. The first component is an elongated core member with a longitudinal slot for receiving the edge of the electrode. This core member is made of relatively flexible material and includes multiple transverse perforations for housing retaining pins passed through corresponding holes in the electrode plate in substantially the same manner as in conventional edge strips. The second component is an elongated sleeve with a cross-section conforming to the geometry of the core member so as to provide a snug support structure that wraps around the core and contains the pins in place. The sleeve is made of relatively rigid material that is inert to the electrolytic solution.

20 Claims, 5 Drawing Sheets

ELECTRODE EDGE STRIP WITH INTERIOR FLOATING RETAINING PINS

BACKGROUND OF THE INVENTION

1. Field of the Invention

This invention is related in general to edge strips for electrodes used in electrolytic processes such as electroforming, electrolytic extraction and refining of metals. In particular, the invention describes a padded edge strip with floating retaining pins that significantly reduce the deposition of material on the edges of electrode plates and around pin holes during the electrolytic process.

2. Description of the Related Art

Electrolysis is utilized to extract metals and other cations from electrolytic solutions. The extraction process is carried out by passing an electric current through an electrolyte solution of a metal of interest, such as copper, zinc, gold, silver, or lead. The metal is extracted by electrical deposition as a result of current flow between a large number of anode and cathode plates immersed in cells of a dedicated extraction tank house. Cathodes are generally constructed of a metal alloy, such as titanium or copper alloys and various grades of stainless steel resistant to corrosive acid solutions. In the most efficient processes, each cathode consists of a thin sheet of metal of uniform thickness (2–4 mm) disposed vertically between parallel sheets of anodic material, so that a uniform current density is produced throughout the surface of the cathode. A solution of metal-rich electrolyte and various other chemicals, as required to maintain an optimal rate of deposition, is circulated through the extraction cells. As an electrical current is passed through the anodes, electrolyte and cathodes, a pure layer of electrolyte metal is electro-deposited on the cathode surface, which becomes plated by the process.

The layer of pure metal so deposited is grown to a specific thickness on the cathode during a predetermined period of process time and then the cathode is removed from the cell. It is important that the layer of metal deposited be recovered in uniform shapes and thicknesses and that its grade be of the highest quality, so that it will adhere to the cathode blank during deposition and be easily removed by automated stripping equipment afterwards. The overall economy of the production process depends in part on the ability to mechanically strip the cathodes of the metal deposits at high throughputs and speeds without utilizing manual or physical intervention. To that end, the cathode blanks must have a surface finish that is resistant to the corrosive solution of the tank house and must be strong enough to withstand their continuous handling by automated machines without pitting or marking. Typically, the stripping process involves a step during which the cathode plates are slightly bent to cause the product layer to become separated. Any degradation of the blank's finish causes the electro-deposited metal to bond with the cathode resulting in difficulty of removal and/or contamination of the deposited metal.

It is very important that metal deposition be avoided along the edges of the electrodes to prevent the formation of a continuous layer of deposit between opposite sides of the plate which would complicate and delay the stripping process. Thus, in order to prevent electrolyte build-up along the double-sided edges of the starter sheet, which would impede the automated separation of the product at the end of each cycle, these edges are masked with an insulating strip fastened to the electrode. Such edge strips are designed to tightly wrap around the edges of the starter sheet and prevent deposition of material past the line of contact between the strip and the starter sheet. In order to improve the uninterrupted contact between the strip and the starter sheet, several kinds of edge strips have been developed with different advantages best suited to specific applications.

For example, U.S. Pat. No. 4,406,769 to Berger (1983) discloses an edge protector consisting of a strip having an H-shaped cross-section so as to provide open slots on opposite sides. One slot is defined between a pair of parallel jaws and is adapted for receiving the edge of an electrode; the other slot is substantially semicircular and is adapted to receive a tubular member in compression, so that its insertion results in a leveraged narrowing of the first slot and a corresponding tight frictional connection between the edge strip and the cathode.

In U.S. Pat. No. 4,776,928 (1988), Perlich describes a co-extruded structure for an edge protector consisting of a rigid U-shaped member having parallel jaws that define a slot for receiving the edge of an electrode and a pair of resilient lips attached to the ends of the jaws to press tightly against the electrode edge, thereby impeding penetration of electrolyte. This patent first disclosed the concept of using dual-durometer co-extruded members to improve gripping of the edge strip to the electrode surface.

In U.S. Pat. No. 5,314,600 (1994), Webb et al. introduced the concept of including a longitudinal groove within the edge slot for accommodating and engaging transverse pins protruding from the electrode. This edge protector also includes expansion channels to facilitate the insertion of the electrode's edge into the protector's slot.

Finally, U.S. Pat. No. 5,549,801 to Perlich (1996) describes an edge protector that includes a resilient hinge for improving the adherence of the strip to the edge of the electrode. An expansion member is also provided to secure the edge strip firmly in place.

Problems remain in the art due to the fact that edge strips need to be sufficiently rigid to retain their shape over severe temperature cycles and maintain continuity of contact with opposite surfaces of the starter sheet's double-sided edges. Since the compressive force exerted by the strip on the edge depends on the resilience of the strip's material, the tightness of the connection tends to diminish as the material ages and deteriorates through thousands of deposition and stripping cycles. It is critical that a sufficient degree of compression on the edge of the electrode plate be present at all times to prevent penetration of the electrolyte solution during the deposition process. If the material is too rigid, the edge strip's performance becomes very dependent on a perfect fit of the starter sheet within the strip's edge slot; if too resilient, the strip may more easily conform to variations in smoothness and thickness in the starter sheet but it may also be easily deformed by shocks and buckling forces, which all result in electrolyte solution penetration and material deposition within the strip's boundary.

Another serious problem derives from the fact that edge strips are fastened to the cathode through pins placed tightly through the plate's edge in transverse perforations disposed along the length of the strip. As a result of the bending to which the plate and strip are subjected during the stripping process, lateral stresses are necessarily imposed on the pins and tend to wear out both the pins and the perforations in the edge strip, thereby producing gaps that expose the metallic edge of the cathode plate to the electrolyte solution in which the cathode is immersed. This in turn produces the deposition of electrolyte in the gaps and the formation of very undesirable nodules around the pins and in the perforations.

In practice, once edge strips begin to have a less than perfect fit over the edge of a plate as a result of fatigue or damage, the electro-deposition metal penetrates through any gap and forms irregular deposits that make it difficult to strip the product from the plates. As a result, there is a tendency in an industrial environment to abuse the plates during the stripping process by bending them more than normal and resorting to hammering or other undesirable practice to remove infiltrated material, which causes further damage to the edge strips and in turn more undesirable build-up. This cycle of events rapidly destroys the effectiveness of normal edge strips and compels their premature replacement.

Therefore, there still exists a need for an improved electrode edge protector. The present invention is based on a novel construction approach that greatly reduces infiltration of electro-deposited material.

BRIEF SUMMARY OF THE INVENTION

The primary objective of this invention is an electrode edge protector that retains optimal fit characteristics over time for protecting an electrode's edge and preventing penetration of solution during the electrolytic process.

Another goal of the invention is an edge strip that is completely isolated from its retaining pins, so that penetration of electrolyte toward the cathode plate through pin openings in the edge strip is not possible.

Another objective is an edge strip having a resilient layer is abutting the entire contact surface with the edges of the plate, thereby allowing the plate to bend during the stripping process without causing material fatigue or damage to the edge strip.

Another goal is to provide an electrode edge protector that performs reliably when used with various types of electrodes and with different types of automated mechanical stripping machines and electrode handling equipment.

Finally, an objective is a design and method of manufacture for such an edge protector that accomplish the above mentioned goals in an economical and commercially viable manner.

Therefore, according to these and other objectives, the present invention is an electrode edge protector that includes two distinct components that cooperate to provide a tight and durable fit over the edge of an electrode. The first component is an elongated core member with a longitudinal slot for receiving the edge of the electrode. This core member is made of relatively flexible material and includes multiple transverse perforations for housing retaining pins passed through corresponding holes in the electrode plate in substantially the same manner as in conventional edge strips. The second component is an elongated sleeve with a cross-section conforming to the geometry of the core member so as to provide a snug support structure that wraps around the core and contains the pins in place. The sleeve is made of relatively rigid material that is inert to the electrolytic solution. An alternative embodiment of the invention also includes an additional resilient layer in direct contact with the surface of the electrode edge. This layer enhances the ability of the edge strip to maintain adherence to the electrode under stressed conditions.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DESCRIPTION OF THE PREFERRED EMBODIMENTS OF THE INVENTION

The principal inventive concept of this disclosure lies in the idea of separating the edge protector's portion that fastens it to an electrode from the portion that protects it from the electrolytic solution. This is accomplished by providing a sleeve that encases the pins that fasten the strip to the edge of the plate, so that the pins and their housings are completely isolated and protected from electrolyte infiltration. Even after gaps form between the pins and their housings as a result of wear or abuse, the sleeve prevents buildup of deposits and the formation of destructive nodules around the pins.

Figure 1:
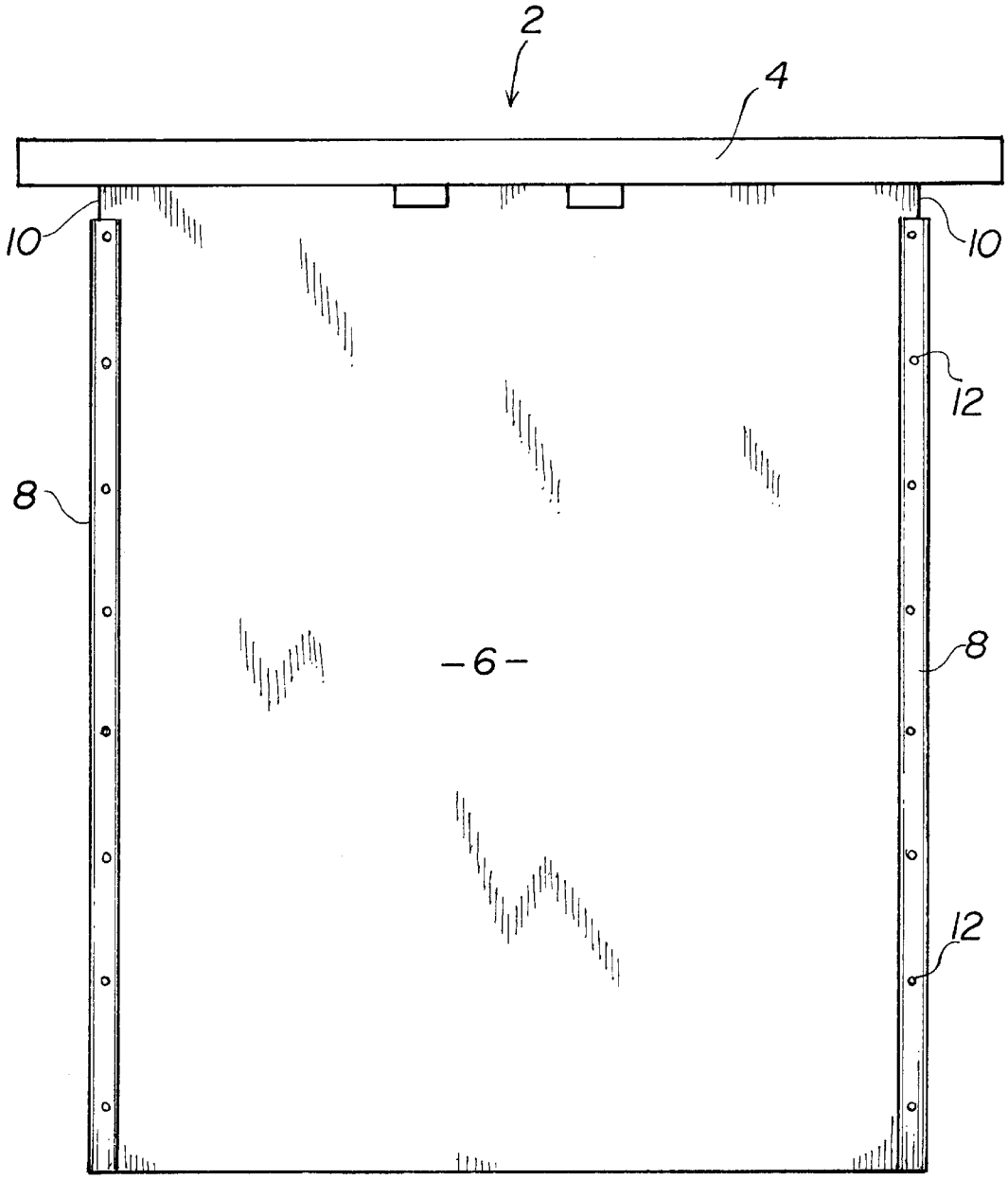
FIG. 1 (PRIOR ART)
FIG. 1 is an elevational view of a typical prior-art electrode for the electro-deposition of metal electrolytes with edge protectors mounted on its vertical edges.

Edge strips are used in the industry in connection with electrodes conventionally called starter sheets, mother plates or mother blanks, depending on the process. Therefore, these terms and the terms cathode and electrode are used interchangeably throughout this disclosure meaning any one of the various types of electrodes found in the art. Referring to the drawings, wherein like parts are designated throughout with like numerals and symbols, FIG. 1 illustrates in elevational view a typical electrolytic cathode 2 according to the prior art, which includes a hanger bar 4 with a starter sheet 6 attached to it, and edge strips 8 shown mounted along the double-sided edges 10 of the starter sheet to prevent deposition and accumulation of electrolyte. Retaining pins 12 are inserted into apposite transverse perforations along the length of each strip passing through corresponding holes along the edge 10 of the starter sheet 6.

Figure 2:
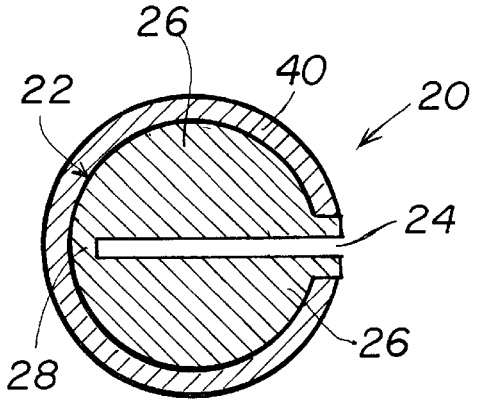
FIG. 2 is a cross-sectional view of an edge protector manufactured according to one embodiment of the present invention.
Figure 3:
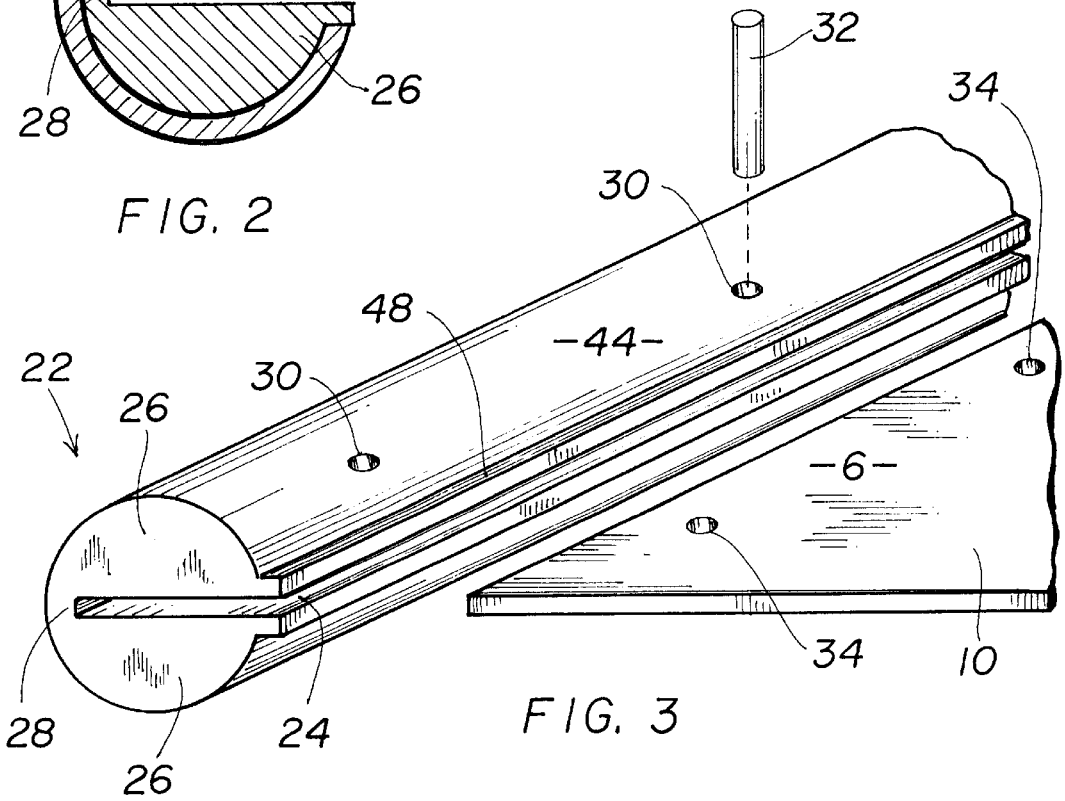
FIG. 3 is a partial perspective view of the inner core portion of the edge protector of FIG. 2 and of the edge of an electrode plate.

FIG. 2 shows the cross-section, which is uniform along the length of the device, of an embodiment of an edge protector assembly 20 according to the present invention. The assembly 20 comprises an elongated continuous inner core 22 having a longitudinal groove or edge slot 24 of the type used in the art for receiving and tightly sandwiching the edge of a starter sheet. The core 22 is preferably of a length sufficient to cover the entire portion of a lateral edge 10 of a starter sheet, or equivalently of the bottom edge 14 thereof, when immersed in an electrolyte solution. The core consists of two substantially semicylindrical jaws 26 that define the longitudinal, generally parallel-sided edge slot 24 and are connected by a longitudinal hinge portion 28 bonded to or integral with each jaw. As illustrated in the perspective view of FIG. 3, the inner core 22 includes perforations 30 sized to receive in tight connection retaining pins 32 that are used to fasten the edge strip to the electrode. As also seen in the figure, the edge 10 of the starter plate contains perforations 34 that match the longitudinal position of the core perforations 30, so that they can be engaged by the pins 32 after the starter sheet is inserted into the groove 24 and both sets of perforations are aligned. The structure and application of the inner core 22 correspond in essence to a conventional edge strip.

Figure 4:
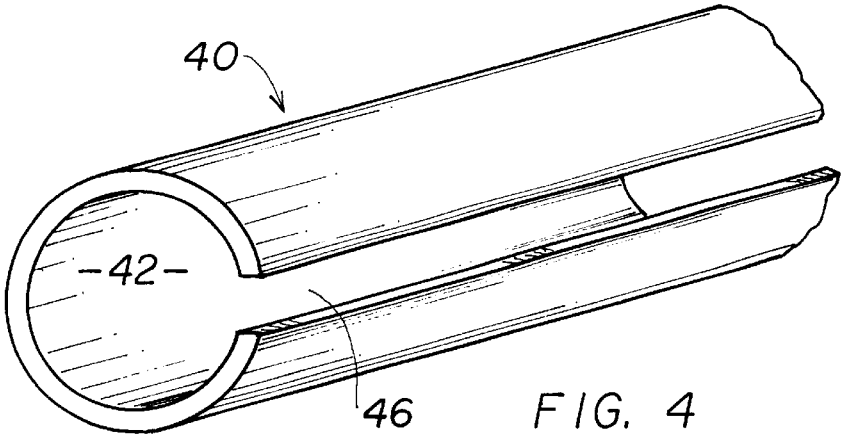
FIG. 4 is a partial perspective view of the outer-sleeve cover portion of the edge protector of FIG. 3.
Figure 5:
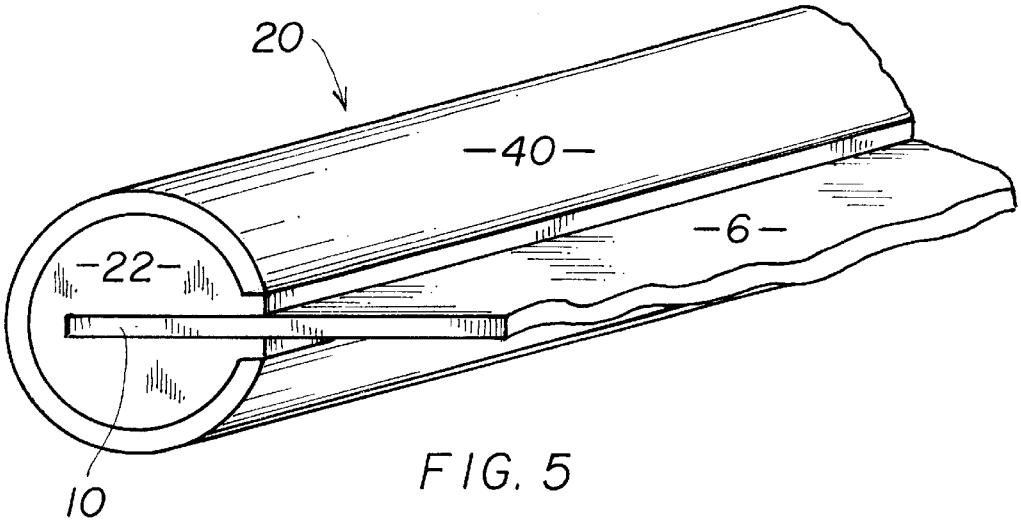
FIG. 5 is a partial perspective view of the edge protector of FIG. 2 attached to the edge of an electrode plate.

Referring to FIGS. 2 and 4, the assembly 20 of the invention further includes an elongated cover or sleeve 40 sized to slip over the inner core 22 (after assembly on the electrode) and provide a rigid housing for the unit. The sleeve 40 consists essentially of a tube with an inner surface 42 shaped to substantially match the outer surface 44 of the core 22. The sleeve 40 also includes a longitudinal slot 46 sized to receive the lips 48 of the inner core 22 and press them against the edge 10 of the electrode after assembly, as illustrated in FIG. 5. Thus, the sleeve 40 is completely separate from the pins 32 and the perforations 30 that house them; moreover, the sleeve isolates the pins and the perforations from the electrolyte solution when the edge strips are immersed. Obviously, the pins 32 must not be longer than the diameter of the inner core 22, so that they are completely contained within the perforations 30 and the sleeve 40 can be slipped longitudinally over the assembled core.

In addition to the idea of keeping the retaining pins 32 isolated from the electrolyte, the invention is also directed at minimizing the structural damage suffered by edge strips during routine use. As mentioned, the electrode plates are often bent to facilitate the removal of the electroplated product. Since the outer shell of edge strips must be sufficiently rigid to seal the edge of the plate under normal operation, bending of the plate produces lateral stresses between the pins 32 and their openings 30 that soon loosen them and create gaps around the pins. These gaps allow the electrolyte into the edge strip toward the metallic plate and become the sites of undesirable deposits.

Figure 6:
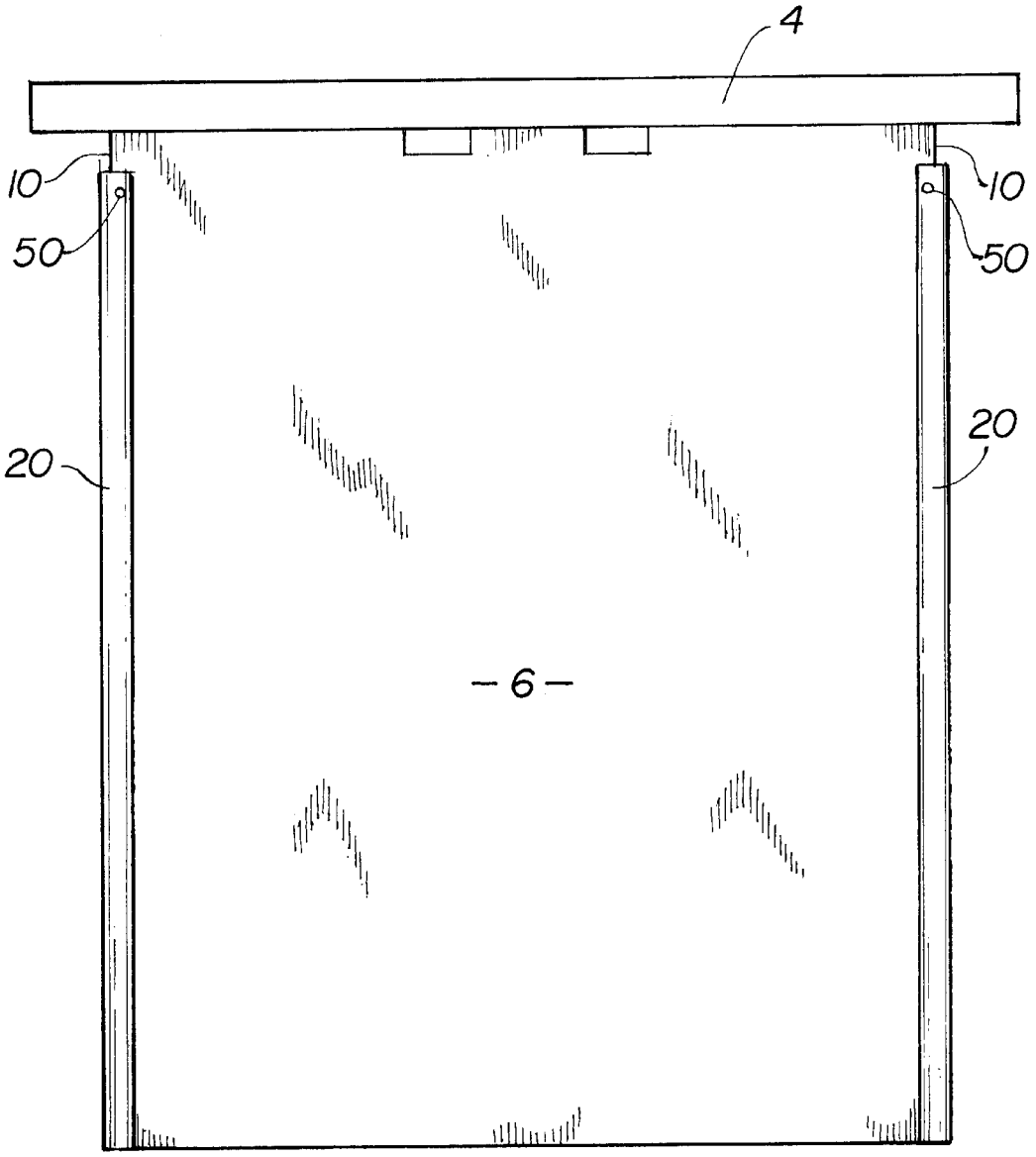
FIG. 6 is an elevational view of the edge protector of FIG. 2 attached to an electrode plate.

The present invention corrects this problem because the outer sleeve 40 prevents hydrolyte penetration into the perforations 30 even after the pins become lose. Because of their novel structure, as illustrated in FIG. 6, the assembled edge strips 20 of the invention do not have any exposed pins or openings within the electrolyte. Moreover, in order also to reduce the normal wear and tear of the pins and the openings, the invention makes it possible to select different materials for the core 22 and the sleeve 40 with physical characteristics particularly suited for their respective functions. Thus, the core 22 is preferably made of a resilient material, such as flexible polyvinylchloride (PVC), methyltertiarybuthylether (MTEB), ethylene-propylene rubber (EPDM), and natural rubber, capable of retaining a continuous seal over the plate 6 during normal operation and of regaining its shape rapidly when subjected to unusual deformation. At the same time, the sleeve 40 is preferably made of rigid material, such as PVC, polypropylene, chlorinated polyvinylchloride (CPVC), or acrylonitrile-butadiene-styrene (ABS), capable of housing the assembled core 40 on the edge of a plate and protecting the assembly during use. It is noted that the opening of the slot 46 is preferably sufficient to permit normal bending of the plate 6 within the resilient range of motion of the core 22 without material deformation to the structure of the sleeve 40. Therefore, the sleeve 40 can be much more rigid than the core 22, as desirable for strength and durability of the unit, without loss of functionality for the purposes of the invention. Note also that the sleeve 40 does not require any locking mechanism to prevent its release from the electrode plate; the inner core 22 performs that function. If desired, a single pin 50 passed through the entire protector assembly and the electrode plate 6 can be used to prevent longitudinal shifts of the sleeve 40 with respect to the core 22. In such case, it is preferable to place the pin 50 at a location higher than the electrolyte level in the electrolytic cell, as shown in FIG. 6, so that it is not immersed during use and damage to it is minimized.

The size of the edge slot 24 is selected for close-fitting, tight frictional engagement with opposite parallel surfaces of the electrode's double-sided edge 10. obviously, the exact dimensions depend on the thickness of the plate for which the edge strip is intended. Typically, for an electrode about 3 mm thick, the slot 24 is about 20 mm deep and slightly less than 3 mm thick in uncompressed condition, so that its inner surfaces press firmly against the edge of the stater sheet after assembly. In the preferred embodiment of the invention, the inner core 22 has dimensions corresponding approximately to a cylinder with a diameter of about 25 mm and a lip 48 about 3 mm wide and slightly more than 3.5 mm deep; the outer sleeve 40 is a tube about 4 mm thick with an inside cross-sectional perimeter conforming to the shape of the core 22 and a slot 46 about 10 mm wide, as illustrated in the figures. Since the edge protector of the invention is assembled by sliding the sleeve 40 over the core 22, the two components must obviously be sized with sufficient precision and tolerance to permit that operation on site.

The strip assembly 20 is installed simply by slipping the core 22 over the edge of the starter sheet such that it fits snugly within the edge slot 24 and the pin perforations 30 are aligned with the corresponding perforations 34 in the starter sheet. An insulating tape may be used wrapped around the starter-sheet edge 10, as conventionally done with prior-art edge protectors. During the process of installation, the resilient hinge portion 28 facilitates the initial fitting of the starter sheet's edge into the edge slot 24. The inner core 22 is then secured to the electrode by passing a pin 32 through each set of aligned perforations 30,34, making sure that no part of a pin remains exposed out of its housing. The sleeve 40 is then slipped longitudinally over the core 22 to complete the assembly. As a result, the pins 32 become completely encased and the edge 10 of the electrode 6 is compressed within the edge slot 24.

It is understood that all components of the edge protector assembly 10 are manufactured with electrically insulating materials that are chemically and thermally stable in the environments of intended use, such as polypropylene, PVC, acrylic/polyvinyl chloride (APVC), CPVC, and ABS components. Within the classes of materials suitable for the invention, a relatively rigid and hard plastic is selected for the sleeve 40, while a relatively flexible and resilient elastomer is selected for the core 22, such plastics being preferably capable of extrusion. The materials chosen for the preferred embodiment of the invention have a durometer hardness in the range of 75 to 90 on the D scale (such as CPVC's) for the rigid sleeve and have a durometer rating in the range of 60 to 80 on the A scale (EPDM, fluoroelastomers such as VITON®, MTBE, polytetrafluoroethane (PTFE, Teflon®), and flexible PVC for the resilient core member.

Figure 7:
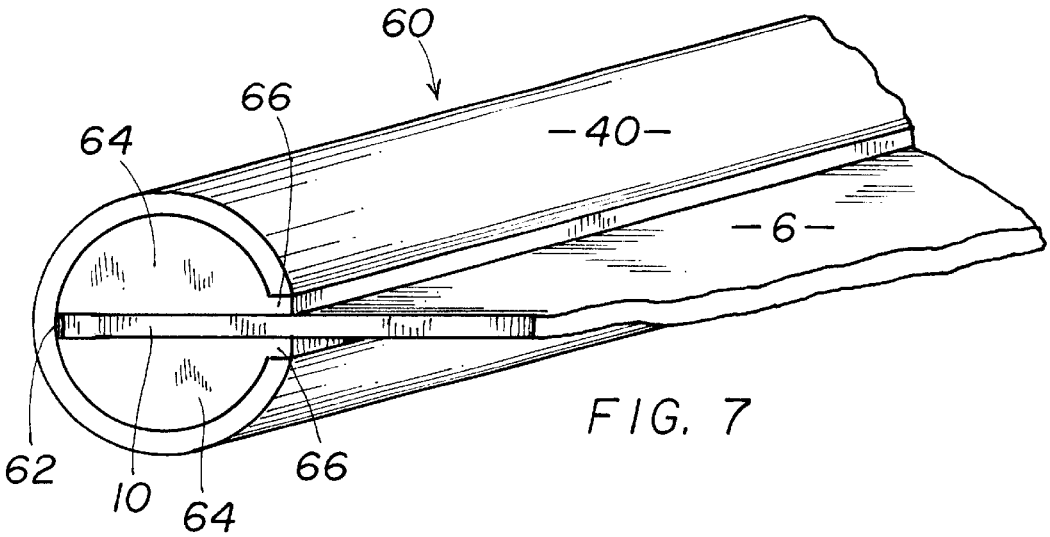
FIG. 7 is a partial perspective view of another embodiment of the edge protector of the invention attached to the edge of an electrode plate.
Figure 8:
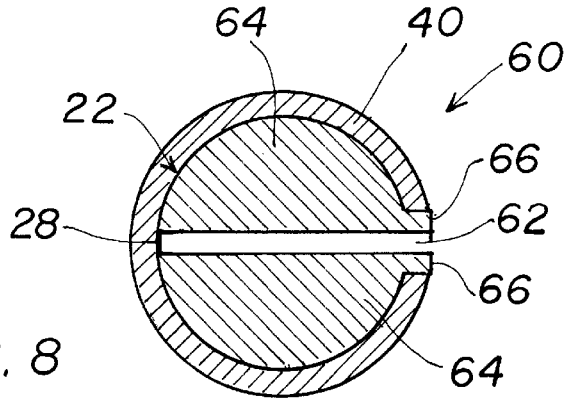
FIG. 8 is a cross-sectional view of the edge protector of FIG. 7.

In another embodiment 60 of the invention, shown in FIGS. 7 and 8, the edge slot 62 is extended the entire diameter of the inner core, so that the core consists of two symmetrical members 64 having a substantially semi-cylindrical shape with a lip 66. This embodiment is functionally equivalent to that of FIGS. 2–5, and may be preferred for reasons of manufacture or assembly.

Figure 9:
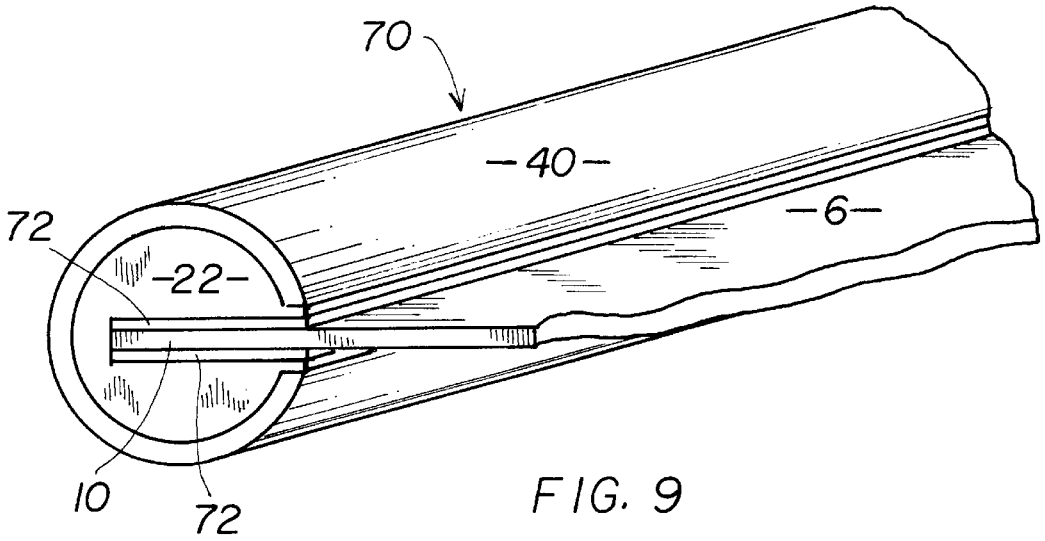
FIGS. 9 and 10 are partial perspective views of other embodiments of the edge protector of the invention including additional layers of resilient material in contact with the edge of an electrode plate.
Figure 10:
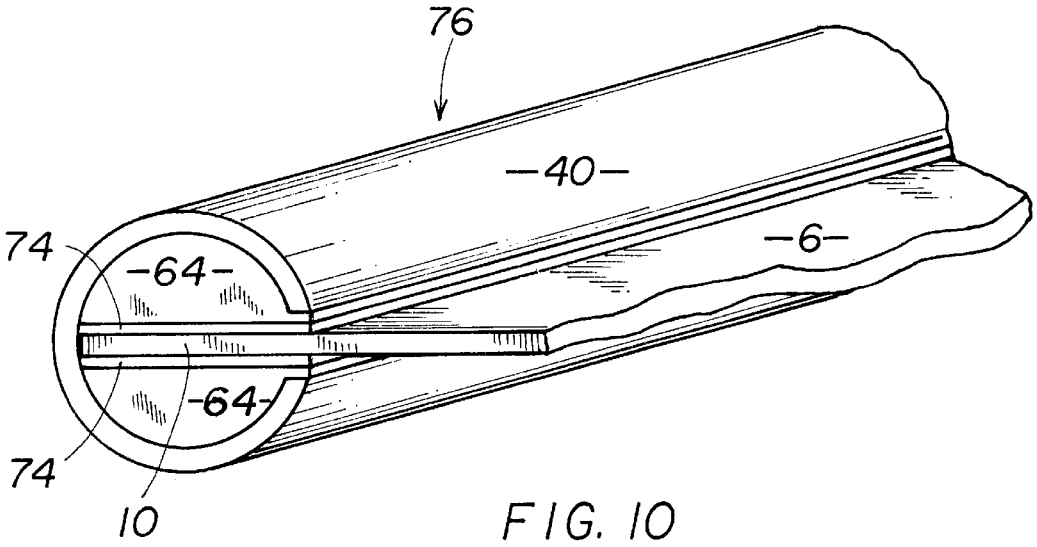

In yet other embodiment 70 of the invention, shown in FIG. 9, the performance of the inner core 22 is further improved by the addition of a layer of relatively-soft and resilient material 72 facing the electrode's surface. This material is selected to be yet more resilient than the one used for the core 22 of the invention and is used to further improve contact with the electrode surface, thereby enhancing prevention of electrolyte penetration and electrical conductivity. Such material can be, for example, PVC, EPDM or natural rubber with a lower durometer index. Similar resilient layers 74 are illustrated in FIG. 10 in an embodiment 76 of the invention corresponding to the edge strip 60 of FIGS. 7 and 8.

In structural terms, the present invention differs from the prior art in its dual-component approach which makes it possible to completely isolate the retaining pins from the electrolyte and substantially isolate the outer rigid structure of the strip from the stresses imposed on its inner resilient component. Obviously, the specific cross-sectional shapes of the inner core and outer sleeve are not critical to the invention so long as such that the sleeve securely encases the core. As one skilled in the art would readily understand, it is preferable, but not essential, that the sleeve and core conform to each other. The substantially circular cross-sectional geometry shown for the components of the invention is preferred because convenient and suitable for convenient engagement.

Various other changes in the details, steps and materials that have been described may be made by those skilled in the art within the principles and scope of the invention herein illustrated and defined in the appended claims. Thus, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent apparatus and methods.

I claim:

1. An edge protector for an electrode having a double-sided edge, comprising the following elements:

an inner core with a longitudinal groove for receiving an edge of the electrode, said inner core consisting of two jaws and a resilient longitudinal hinge portion capable of defining the longitudinal groove, said inner core being made of a material with a durometer rating in the range of 60 to 80 on the A scale;

an outer sleeve encasing the inner core and having a longitudinal slot aligned with said groove of the inner core; and transverse pin perforations only in the inner core and electrode where retaining pins are used for engaging corresponding perforations in the edge of the electrode and the inner core.

2. The edge protector of claim 1, further comprising a layer of resilient material attached longitudinally to a wall of said groove.

3. The edge protector of claim 1, further including transverse pin perforations in the inner core and retaining pins for engaging corresponding perforations in the edge of the electrode.

4. The edge protector of claim 3, further comprising a layer of resilient material attached longitudinally to a wall of said groove.

5. The edge protector of claim 1, wherein the outer sleeve is made of rigid material.

6. An edge protector for an electrode having a double-sided edge, comprising the following elements:

an inner core with a longitudinal groove for receiving an edge of the electrode, an outer sleeve encasing the inner core and having a longitudinal slot aligned with said groove of the inner core; and transverse pin perforations only in the inner core and electrode where retaining pins are used for engaging corresponding perforations in the edge of the electrode and the inner core.

7. The edge protector of claim 6, further comprising a layer of resilient material attached longitudinally to a wall of said groove.

8. The edge protector of claim 6, wherein said longitudinal groove is extended through a width of the inner core.

9. The edge protector of claim 8, further comprising a layer of resilient material attached longitudinally to a wall of said groove.

10. The edge protector of claim 6, wherein the inner core is made of resilient material and the outer sleeve is made of rigid material.

11. An edge protector for an electrode having a double-sided edge, comprising the following elements:

an elongated inner core with a predetermined cross-section and a longitudinal groove, said inner core consisting of two jaws and a resilient longitudinal hinge portion capable of defining the longitudinal groove, said inner core being made of a material with a durometer rating in the range of 60 to 80 on the A scale;

an elongated outer sleeve with an inner perimeter substantially conforming to said cross-section of the inner core and a longitudinal slot aligned with said groove of the inner core;

wherein said longitudinal groove is adapted for close-fitting engagement of said double-sided edge of the electrode; and transverse pin perforations only in the inner core and electrode where retaining pins are used for engaging corresponding perforations in the edge of the electrode and the inner core.

12. The edge protector of claim 11, further comprising a layer of resilient material attached longitudinally to a wall of said groove.

13. The edge protector of claim 11, further including transverse pin perforations in the inner core and retaining pins for engaging corresponding perforations in the edge of the electrode.

14. The edge protector of claim 13, further comprising a layer of resilient material attached longitudinally to a wall of said groove.

15. The edge protector of claim 11, wherein the outer sleeve is made of rigid material.

16. An edge protector for an electrode having a double-sided edge, comprising the following elements:

an elongated inner core with a predetermined cross-section and a longitudinal groove, said longitudinal groove is adapted for close-fitting engagement of said double-sided edge of the electrode;

an elongated outer sleeve with an inner perimeter substantially conforming to said cross-section of the inner core and a longitudinal slot aligned with said groove of the inner core; and transverse pin perforations only in the inner core and electrode where retaining pins are used for engaging corresponding perforations in the edge of the electrode and the inner core.

17. The edge protector of claim 16, further comprising a layer of resilient material attached longitudinally to a wall of said groove.

18. The edge protector of claim 16, wherein said longitudinal groove is extended through a width of the inner core.

19. The edge protector of claim 18, further comprising a layer of resilient material attached longitudinally to a wall of said groove.

20. The edge protector of claim 16, wherein said predetermined cross-section is substantially circular.

* * * * *